US006199006B1

(12) United States Patent
Weiss et al.

(10) Patent No.: US 6,199,006 B1
(45) Date of Patent: Mar. 6, 2001

(54) CONTROL SYSTEM FOR INTERNAL COMBUSTION ENGINES

(75) Inventors: Heinz Weiss, Bensheim (DE); Ronnie Franklin Burk, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/300,682

(22) Filed: Apr. 27, 1999

(30) Foreign Application Priority Data

Apr. 29, 1998 (DE) ..... 198 19 122

(51) Int. Cl.[7] ..... G06G 7/70; F02D 41/30

(52) U.S. Cl. ..... 701/102; 701/115; 701/110; 180/179

(58) Field of Search ..... 123/486, 480, 123/492, 493, 494, 435; 701/115, 104, 102, 110; 477/63, 198, 98; 180/179

(56) References Cited

U.S. PATENT DOCUMENTS

| | | | | |
|---|---|---|---|---|
| 3,927,528 | * | 12/1975 | Kolk et al. | 60/431 |
| 4,528,958 | * | 7/1985 | Yoshida et al. | 123/442 |
| 4,945,870 | * | 8/1990 | Richeson | 123/90.11 |
| 5,109,730 | * | 5/1992 | Zahn et al. | 477/121 |
| 5,113,721 | * | 5/1992 | Polly | 477/80 |
| 5,117,702 | * | 6/1992 | Rodeghiero et al. | 74/359 |
| 5,123,397 | * | 6/1992 | Richeson | 123/568 |
| 5,284,116 | * | 2/1994 | Richeson, Jr. | 123/406.2 |
| 5,343,780 | * | 9/1994 | McDaniel et al. | 477/108 |
| 5,508,923 | * | 4/1996 | Ibamoto et al. | 701/70 |
| 5,575,737 | * | 11/1996 | Weiss | 477/43 |
| 5,983,156 | * | 11/1999 | Andrews | 701/115 |

OTHER PUBLICATIONS

"John Deere Construction Equipment—Motor Graders".
"Power Tech 10.5/12.5" Diesel Engines, dated Apr. 98.

* cited by examiner

*Primary Examiner*—Henry C. Yuen
*Assistant Examiner*—Hieu T. Vo

(57) ABSTRACT

A control system for internal combustion engines of an agricultural tractor include a memory unit in which is stored engine performance maps. The control system includes a vehicle speed sensor and transmits control signals to an electronically controlled fuel injection system to control the fuel injection quantity as a function of sensed speed, target value inputs and as a function of the engine performance maps. The control system, in response to sensed vehicle speed, limits the maximum engine output as a function of the vehicle speed. In particular, at lower vehicle speeds the engine output is limited to a level which is lower than the rated engine output.

8 Claims, 2 Drawing Sheets

DPI 48,3kN
B
P168
D
P100
A
0
7km/h
10
12km/h
20
30
40
50
60
70
80
VEHICLE SPEED (km/h)
50
45
40
35
30
25
20
15
10
5
0
DRAWBAR FORCE (kN)

CONTROL SYSTEM FOR INTERNAL COMBUSTION ENGINES

BACKGROUND OF THE INVENTION

The invention relates to a control system for an internal combustion engines of agricultural or commercial vehicles, in particular for engines of agricultural tractors.

Agricultural tractors are designed with respect to desired values of drawbar force and desired gearbox speeds. A standard tractor for plowing at 6 to 7 kilometers per hour (km/h), for example, is designed for a power output of 100 DIN-kW. In order to apply the necessary drawbar force to the ground, the tractor is equipped with heavy weights and large tires. The lower the operating speed is, the greater the torques that can be transmitted at constant engine power output. At low speeds, for example, below 6 km/h, the components of the driveline are protected against overloads by the slip of the wheels. A standard tractor with an output of 100 DIN-kW can pull a trailer of 20 t on a track that rises 1.5 m in a distance of 100 m (upgrade of 1.5%), at a maximum speed of 50 km/h.

Tractors are increasingly driven longer distances on roads, during which higher speeds are desired. For example, it is desirable for a tractor to pull a trailer of 20 t on an upgrade of 1.5% at a speed of 65 km/h. However, this requires an engine power output of approximately 130 kW. For a speed of 80 km/h approximately 168 kW are required. In order to attain these speeds, the engine, the tractor support structure and all other tractor components must be designed for the stated power output values. For operation in the field, however, the drive system of such a tractor would be over-designed and hence uneconomical. As a point of reference, it can be assumed that an overload of the vehicle components by 10% will reduce their service life by approximately 30%.

With an optimum design differing tractors result for operation on the field and the transport over roads, whose internal combustion engines, drivelines, support structures and other tractor components must be designed for differing power output or load capacity. This is in opposition to the desire to offer tractors at favorable cost for a wide range of applications. Since on the one hand, an efficient and hence low cost manufacturing is possible only with the lowest possible number of models and, on the other hand, the use of over-designed drivelines lead to increased costs.

SUMMARY OF THE INVENTION

An object of the invention is to provide an engine control system which enables a more powerful engine to be used in a tractor with less robust components so that higher transport speeds can be obtained without damaging vehicle driveline components.

This and other objects are achieved by the present invention wherein a control system includes a memory unit in which are stored engine performance maps. The control system transmits control signals as a function of target value inputs (such as provided by a gas pedal) to an electronically controlled fuel injection system to control fuel injection quantity as a function of an engine performance map. The control system includes a vehicle speed sensor and limits or throttles the engine output as a function of the sensed vehicle speed. The invention increases the service life of the driveline and other vehicle components, because it protects such vehicle components from overloads when they are not designed for the maximum possible engine output. In order to avoid overloads on vehicle components, the invention reduces or throttles the engine output, in particular for vehicle speed ranges in which high loads and large torques are generated in the driveline.

The invention makes it possible to provide a single vehicle for differing requirements. Such a vehicle may have an engine with a relatively high power output which permits high transport speeds. The gearbox, the chassis and other vehicle components, however, may be designed for a load that is considerably below the rated output of the engine, for example, components which are adequate for normal field operations. This makes it possible to provide a single tractor type that can meet multiple divergent requirements in high production quantities at reasonable manufacturing costs.

Preferably, the rated power output of the engine is designed for a predetermined maximum vehicle speed. When the vehicle is operated at maximum vehicle speed, there is no limitation of engine power output, aside from the usual inherent power reduction when the rated engine rotational speed is reached. At lower vehicle speeds the engine power output is limited to values that are lower than the rated engine power output. Preferably, the power is limited so that the load capacity of the vehicle components corresponds to each vehicle speed or so that the power does not exceed the load capacity or at least does not significantly exceed it.

An upper speed-drawbar force hyperbolic relationship is defined and stored in an engine performance map memory, which corresponds to the rated power output of the engine and is designed for transport operations at high vehicle speeds for a desired maximum vehicle speed and an associated desired drawbar force value. Furthermore, for an operating condition speed-drawbar force hyperbola, such as a plowing, a lower speed-drawbar force hyperbolic relationship is defined through a predetermined lower vehicle operating speed and a limit drawbar force (DPI) with throttled engine power output and, if necessary, stored in the engine performance map memory. The conformation of the engine power output occurs as a function of the vehicle speed along a smooth equalization or transitional relationship which inter-relates the lower and the upper vehicle speed-drawbar force relationships. The transitional relationship can either be derived by the control system from the upper and the lower speed-drawbar force relationships, or it can be predetermined and stored in the memory unit.

Graphically, these maps and relationships are represented by hyperbolas, and the smooth curve representing the transitional relationship is preferably tangent to the lower velocity region of the lower speed-drawbar force hyperbola (for example, for 100 kW), and is tangent to the upper velocity region of the upper speed-drawbar force hyperbola (for example, for 168 kW), so that a constant smooth transition between the two hyperbolas results.

Preferably, the maximum power output of the engine is continuously lowered starting from the maximum vehicle speed to the operating speed of the vehicle as a proportional function of the measured vehicle speed in the region between the two speed-drawbar force hyperbolas. The lower operating speed is appropriately between 3 and 12 km/h, and is preferably approximately 7 km/h. Furthermore, the engine power output is throttled at the lower operating speed to a power output value that corresponds to the maximum drawbar force that can be transmitted to the ground (of the drawbar output index DPI). The rated engine output corresponds to maximum vehicle speeds between 60 km/h and 90 km/h (preferably approximately 80 km/h) where the reference point is for operation on an upgrade on a slope of 1.5% and with a trailer weighing approximately 20 tons.

DESCRIPTION OF THE PREFERRED EMBODIMENT

Figure 1:
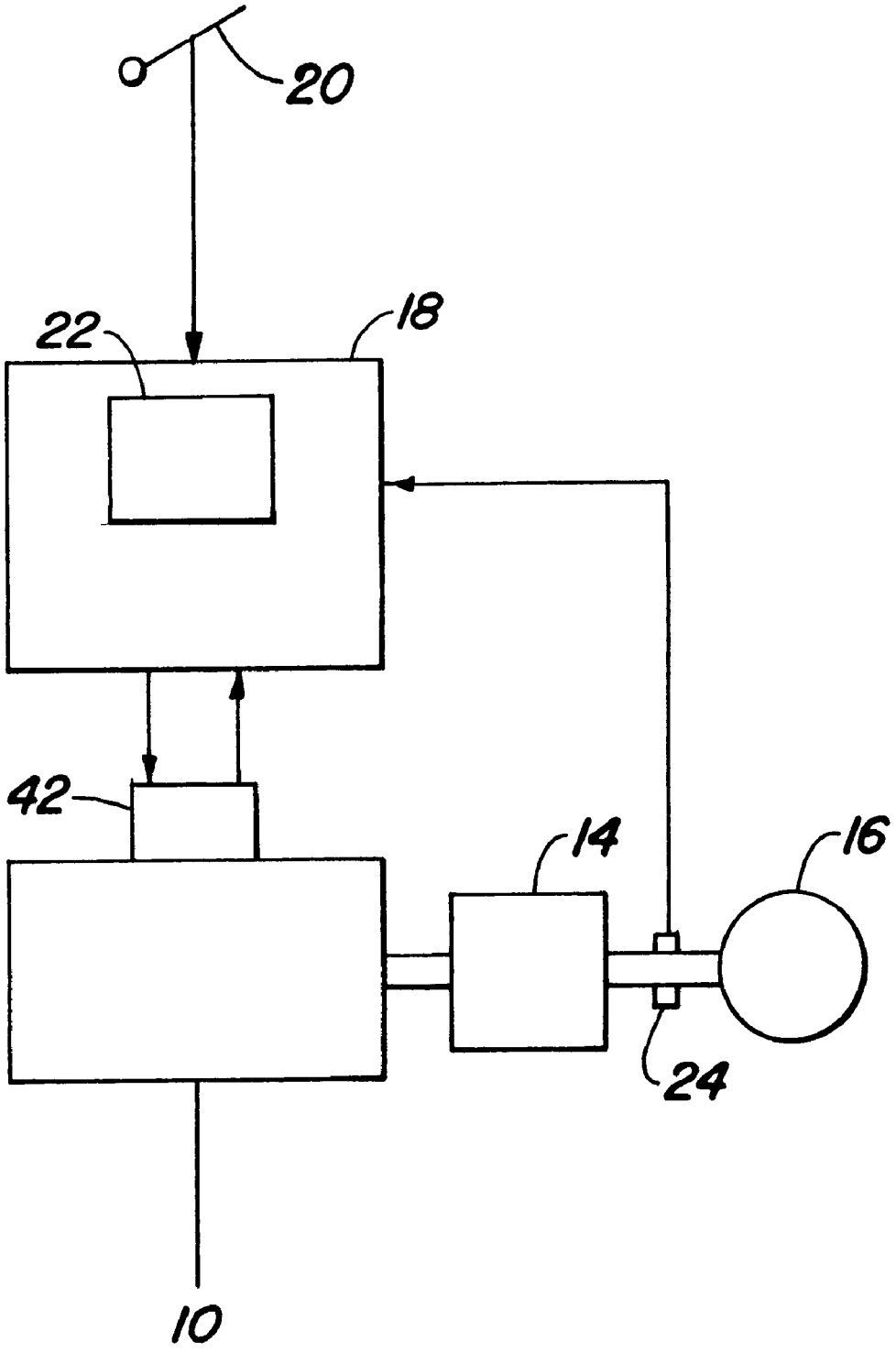
FIG. 1 is a schematic block diagram of a drive system with a control system of the invention.

FIG. 1 shows a drive system with an internal combustion engine 10, an electronically controlled fuel injection pump 12, and a multi-speed gearbox 14 which transmits the engine output to the drive wheels 16, only one of which is shown. The fuel injection pump 12 is controlled by a control system 18, also called motor controller.

The operator can provide target value input for the control system 18 through an operating element 20, such as a gas pedal or an engine rotational speed control lever.

The control system 18 includes a memory 22 for storing engine performance maps, such as for starting, idle, full power, operating element and injection pump characteristics. As a function of the operator input and the stored engine performance maps, the control system 18 determines target value inputs for the fuel injection pump 12. These target values provide guide values for the operating position of the pump 12. The control system 18 receives signals from the fuel injection pump 12 representing its actual operating position, and these signals are used as control deviations for controlling the fuel injection pump 12.

Controls which control an electronically controlled fuel injection system as a function of target value inputs and the consideration of engine performance maps are well known (see, for example, the Technical short information from the Bosch company "Electronic Diesel control with in-line injection pump" (publication number 1 987 724 513/KHNDT-06.91DE) and are therefore not described in any further detail herein.

The output rotational speed of the gearbox 14, which corresponds to the vehicle speed, is detected by a rotational speed sensor 24 and transmitted to the control system 18. The speed sensor 24 may be a rotational speed sensor which senses the rotational speed at the output side of a multi-speed gearbox 14 located downstream of the engine 10 or which senses the rotational speed of the drive wheels 16. However, the vehicle speed can also be sensed directly, for example, by a radar sensor (not shown). For the instantaneous current vehicle speed the control system determines maximum allowable drawbar forces or fuel injection quantities from the engine performance map (see FIG. 2) and, if necessary, limits the target input values for the fuel injection pump.

Figure 2:
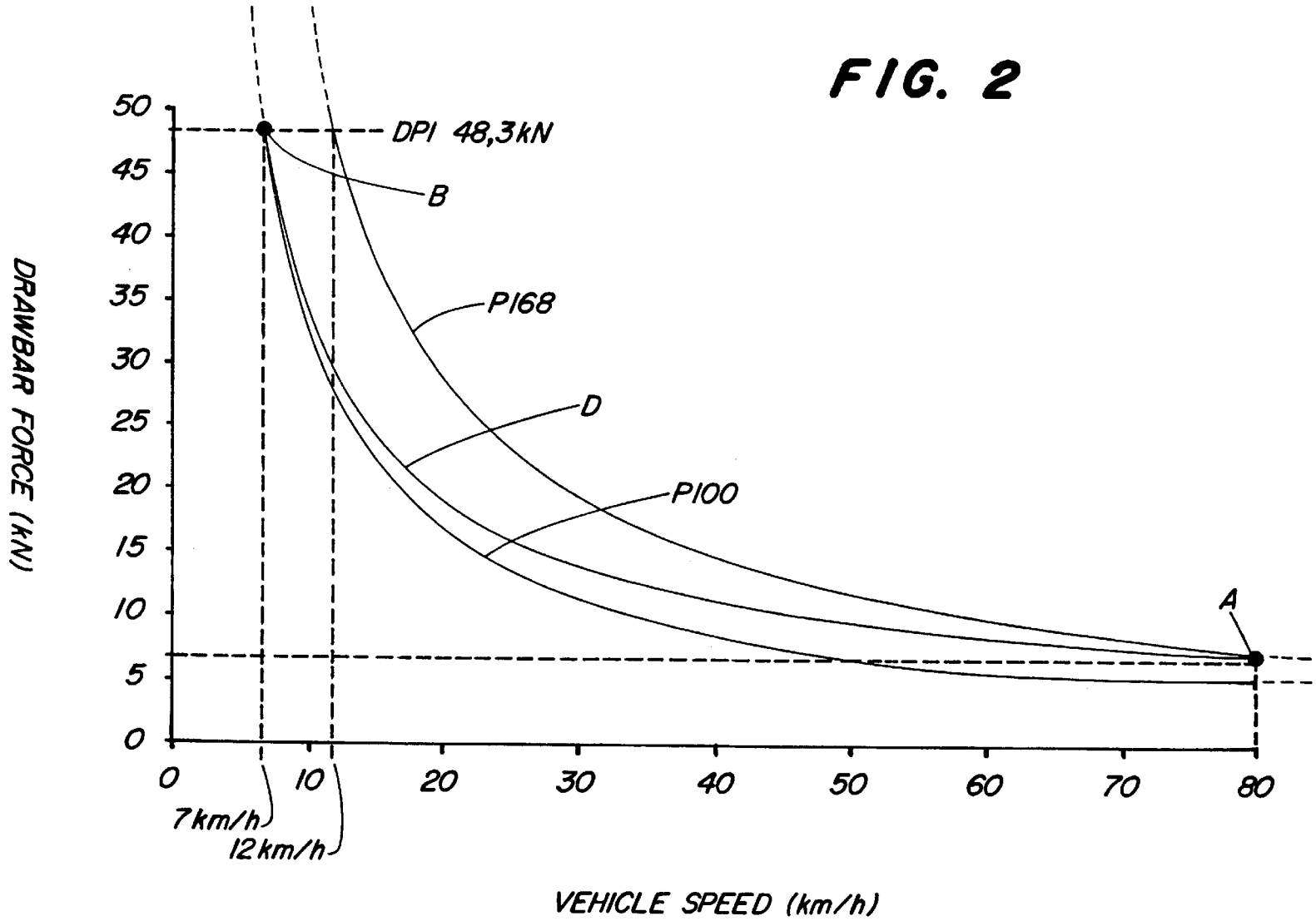
FIG. 2 is a diagram of speed vs. drawbar force.

FIG. 2 shows graphical representations of engine maps or the relationships between the vehicle drawbar forces in kilo-newtons (kN) as a function of the vehicle speed in kilometers per hour (km/h). A first upper speed-drawbar force relationship is represented by hyperbola P168 which is shown for a constant engine rated output of 168 kilowatts (kW). This first relationship is based on an engine having a rated engine output which is selected so that the corresponding hyperbola passes through a point A, for which the drawbar force Z is sufficient to pull a trailer weighing of 20 tons (t) at a maximum vehicle speed of 80 km/h and an upgrade of 1.5%.

A second lower speed-drawbar force relationship is represented by hyperbola P100 which corresponds to a constant engine output of 100 kW. This hyperbola P100 passes through the point B, which corresponds to a vehicle speed of 7 km/h and a drawbar pull of 48.3 kN. At drawbar force values which exceed this value the wheels 16 will slip on normal soil, thereby limiting the torques that must be transmitted by the transmission 14. Point B defines the design criteria that the gearbox and further vehicle components must meet with regard to the power to be transmitted.

In order to operate at both operating points A and B, an engine 10 with a rated power output of 168 kW is employed. The engine output is throttled as a function of vehicle speed along the equalization or transitional relationship represented by curve D. The curve D is tangent in the region of point B to the lower hyperbola P100 and is tangent in the region of point A to the upper hyperbola P168. From point B to point A the curve D is smooth without any jumps and approaches with increasing vehicle speed the hyperbola P168. The transition between the two hyperbolas P100 and P168 can thus occur gradually as vehicle speed increases.

Although the invention has been described in terms of only one embodiment, anyone skilled in the art will perceive many varied alternatives, modifications and variations in the light of the foregoing description as well as the drawing, all of which fall under the present invention. For example, the invention can be applied not only to agricultural tractors but also to other agricultural or commercial vehicles.

We claim:

1. A control system for an internal combustion engine of a vehicle, the control system having a memory unit in which are stored engine performance maps, the control system transmitting control signals to an electronically controlled fuel injection system which controls fuel injection quantity as a function of target value inputs and the engine performance map, characterized by:

a vehicle speed sensor which generates a vehicle speed signal, and the control system, in response to the speed signal, limits an engine power output at vehicle speeds lower than a predetermined vehicle speed; and during low vehicle speeds, the control system limits the engine output to a value which corresponds to a maximum drawbar force which can be transmitted to the ground.

2. A control system for an internal combustion engine of a vehicle, the control system having a memory unit in which are stored engine performance maps, the control system transmitting control signals to an electronically controlled fuel injection system which controls fuel injection quantity as a function of target value inputs and the engine performance map, characterized by:

a vehicle speed sensor which generates a vehicle speed signal, and the control system, in response to the speed signal, limits an engine power output at vehicle speeds lower than a predetermined vehicle speed;

the memory unit has stored within it a first map which represents an upper speed-drawbar force relationship which corresponds to a rated power output of the engine, a second map which represents a lower speed-drawbar force relationship which corresponds to a predetermined lower vehicle operating speed and a limit drawbar force with a throttled engine power output, and a third map which represents a smooth transition between the first and second maps; and the control system controls power output of the engine as a function of the vehicle speed and the third map.

3. The control system of claim 2, wherein:

with respect to a graphical representation of the maps, the third map has a tangential relationship with a lower vehicle speed region of the second map, and the third map has a tangential relationship with a maximum vehicle speed region of the first map.

4. The control system of claim 2, wherein:

the maximum output of the engine is continuously reduced as a function of sensed vehicle speed and the third map as vehicle speed is reduced from a maximum vehicle speed.

5. The control system of claim 2, wherein:

the predetermined lower vehicle operating speed is between 3 km/h and 12 km/h, preferably at 7 km/h.

6. The control system of claim 2, wherein:

the predetermined lower vehicle operating speed is approximately 7 km/h.

7. The control system of claim 2, wherein:

the rated engine output corresponds to a maximum vehicle speed between 60 km/h and 90 km/h.

8. The control system of claim 2, wherein:

the rated engine output corresponds to a maximum vehicle speed of approximately 80 km/h.

* * * * *